United States Patent [19]

Hughes

[11] Patent Number: 4,760,944

[45] Date of Patent: Aug. 2, 1988

[54] SLING ASSEMBLY FOR BOWS, RIFLES, AND THE LIKE

[75] Inventor: Thomas E. Hughes, Canandaigua, N.Y.

[73] Assignee: The Coleman Company, Inc., Wichita, Kans.

[21] Appl. No.: 39,528

[22] Filed: Apr. 17, 1987

[51] Int. Cl.[4] ..... F41B 5/00

[52] U.S. Cl. ..... 224/205; 124/23 R; 224/250; 224/150; 224/901; 224/913; 224/916

[58] Field of Search ..... 224/901, 913, 916, 150, 224/151, 202, 205–208, 228, 235, 250, 251, 257, 258, 264, 236, 149, 917; 124/23 R, 24 R, 86, 88

[56] References Cited

U.S. PATENT DOCUMENTS

| | | | |
|---|---|---|---|
| 811,437 | 1/1906 | Read | 224/250 X |
| 3,227,338 | 1/1966 | Hall | 224/205 |
| 3,327,914 | 6/1967 | Abram | 224/205 X |
| 3,334,794 | 8/1967 | Saari et al. | 224/150 |
| 3,653,564 | 4/1972 | Carter | 224/150 |
| 3,960,302 | 6/1976 | Mazzoni, Jr. | 224/257 X |
| 3,998,367 | 12/1976 | Harding | 224/916 X |
| 4,463,885 | 8/1984 | Ball et al. | 224/250 |
| 4,470,528 | 9/1984 | Dyess | 224/257 |
| 4,518,107 | 5/1985 | Amos | 224/215 |
| 4,621,752 | 11/1986 | Youngbauer | 224/253 |

OTHER PUBLICATIONS

"Adapter Kit, Top Sling", one page only, May 25, 1970.

*Primary Examiner*—Henry J. Recla
*Assistant Examiner*—Ernest G. Cusick

[57] ABSTRACT

A sling assembly for a bow or the like includes a pair of mounting members adapted to be wrapped around the bow and a sling which is removably attached to the mounting members. Each of the mounting members comprises a sheet of fabric and Velcro fasteners on the fabric for securing the fabric after it is wrapped around the bow. A buckle on the fabric is attachable to a buckle on the sling. A sling assembly for a rifle includes one of the bow mounting members and a strap having a buckle on one end and a loop on the other end. The strap can be wrapped around the barrel of a gun, and the buckle is inserted through the loop to form a noose which can be tightened around the barrel.

10 Claims, 2 Drawing Sheets

FIG. 1
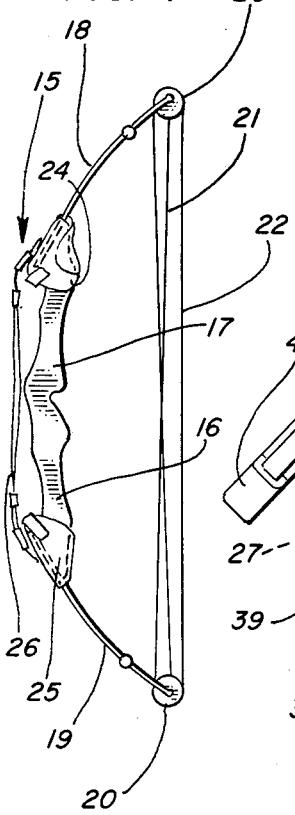
FIG. 2
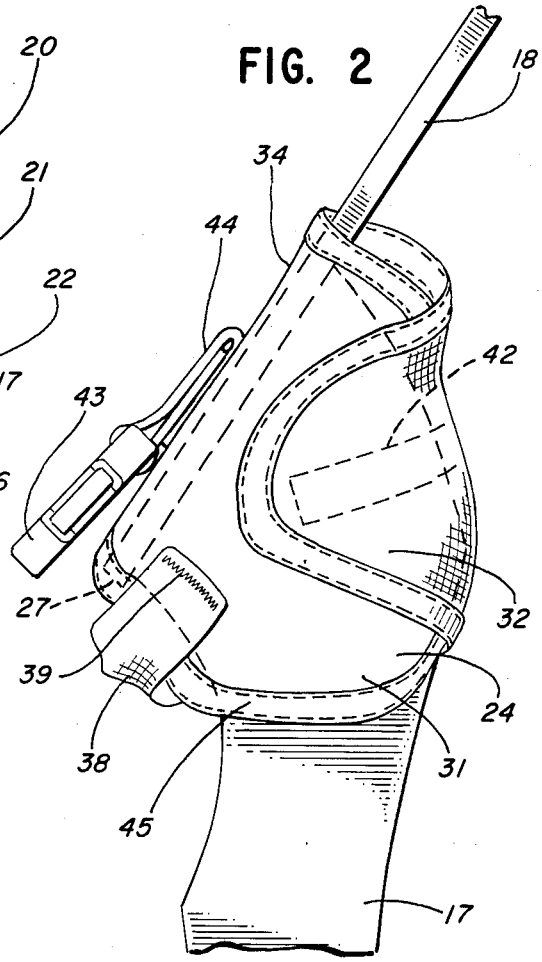
FIG. 3
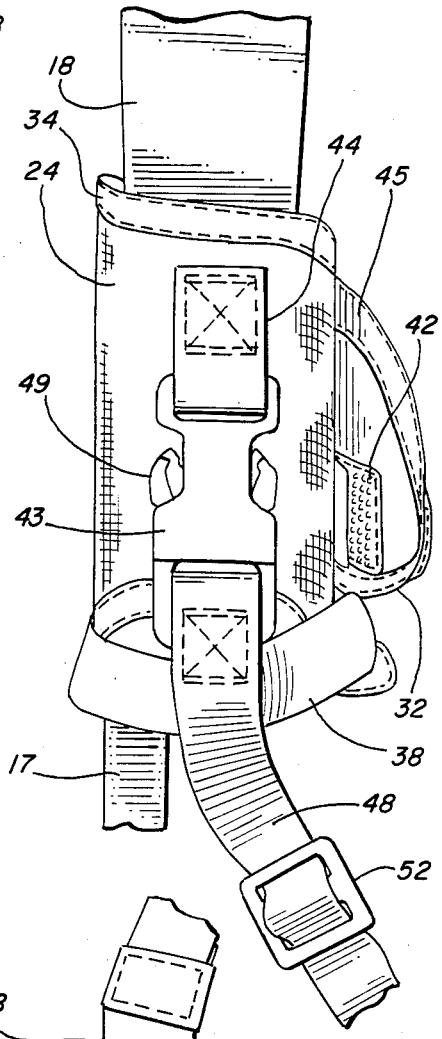
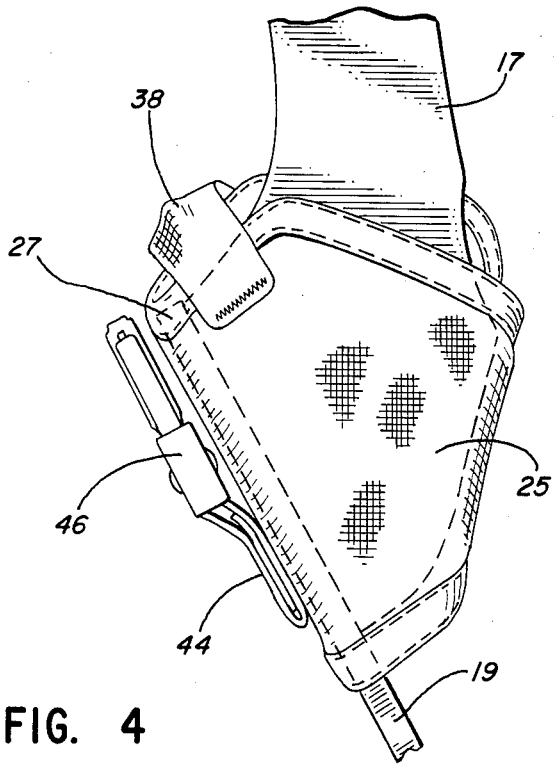
FIG. 4
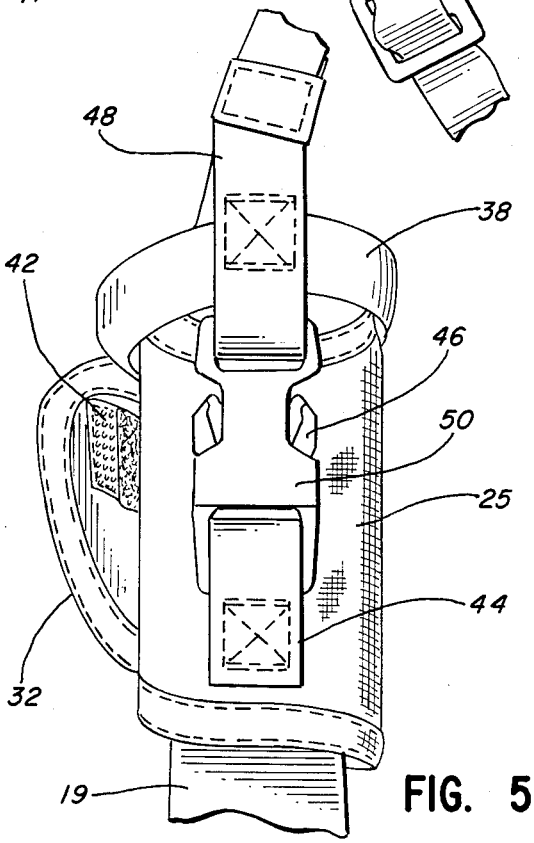
FIG. 5

SLING ASSEMBLY FOR BOWS, RIFLES, AND THE LIKE

BACKGROUND OF THE INVENTION

This invention relates to a sling assembly for a bow or a rifle or similar items. More particularly, the invention relates to a sling assembly which can be attached to and detached from a bow without disassembling the bow and without tools. The sling assembly can also be attached to a gun without tools.

There are many occasions on which a bow hunter finds it advantageous to carry his bow with a sling. For example, when he is carrying items other than the bow to a camp or to a tree stand, it would be desirable to sling the bow over the shoulder or across the back.

There are a number of bow slings on the market, but they require either disassembly of the bow for attachment and detachment or drilling and tapping of the bow riser for mounting an attaching device. However, not everyone has the ability or the desire to disassemble and reassemble a bow properly, particularly compound bows or bows under high compression. Slings which require drilling the bow riser are undesirable because the bow is permanently altered.

Similar considerations apply to a gun such as a rifle or a shotgun except that a gun need not be disassembled to attach a sling. However, it is desirable to be able to attach the sling to the stock and the barrel without permanently altering the gun.

SUMMARY OF THE INVENTION

The sling assembly for a bow comprises a pair of fabric mounting members and a sling which can be removably attached to the fabric mounting members. The fabric is maintained in a U-shaped configuration by a strap which is attached to the legs of the U to form a pocket. The elbow which is formed by the junction of the riser and a limb of the bow is positioned in the pocket, and the ends of the U-shaped fabric are wrapped around the bow and secured by Velcro fasteners. The sling is removably attached to each of the fabric mounting members by buckles on the sling and on the mounting members. The sling assembly for a gun includes one of the fabric mounting members and a strap having a buckle on one end and a loop on the other end. The fabric mounting member is attached to the stock of the gun, and the strap is attached to the barrel by inserting the buckle end through the loop to form a noose through which the barrel is inserted.

BRIEF DESCRIPTION OF THE DRAWING

The invention will be explained in conjunction with illustrative embodiments shown in the accompanying drawing, in which FIG. 1 is an elevational view of a sling assembly formed in accordance with the invention which is attached to a compound bow;

FIG. 2 is an enlarged fragmentary view of the upper mounting member of the sling assembly;

FIG. 3 is a front elevational view of the upper mounting member of the sling assembly with the sling attached;

FIG. 4 is an enlarged fragmentary view of the lower mounting member of the sling assembly;

FIG. 5 is a front elevational view of the lower mounting member with the sling attached;

DESCRIPTION OF THE PREFERRED EMBODIMENTS

Figure 6:
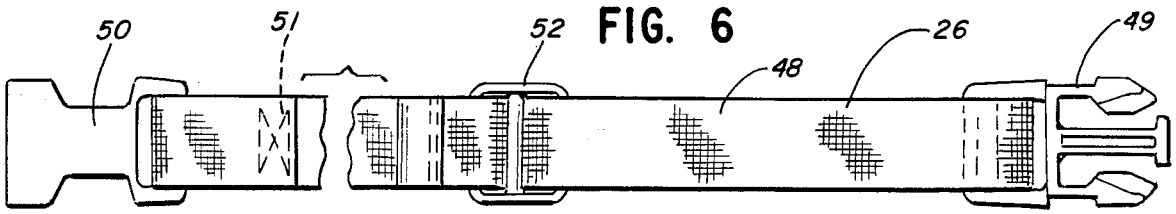
FIG. 6 is a plan view, partially broken away, of the sling.

Referring to FIGS. 1–5, a sling assembly 15 is removably mounted on a conventional compound bow 16. Compound bows are well known and are described, for example, in U.S. Pat. Nos. 3,486,495 and 4,300,521. The compound bow includes a handle or riser 17 and a pair of limbs 18 and 19 which are attached to the ends of the riser. A cable wheel 20 is eccentrically mounted on the end of each of the limbs, and draw cables 21 and bowstring 22 are operatively connected to the eccentric wheels in a manner which is well known in the art.

The sling assembly 15 includes upper and lower mounting members 24 and 25 and sling 26. As can be seen in FIGS. 2 and 4, the junction between the bow riser 17 and each of the limbs 18 and 19 forms an elbow 27. Each of the mounting members 24 and 25 and removably attached to the bow about one of the elbows.

Figure 8:
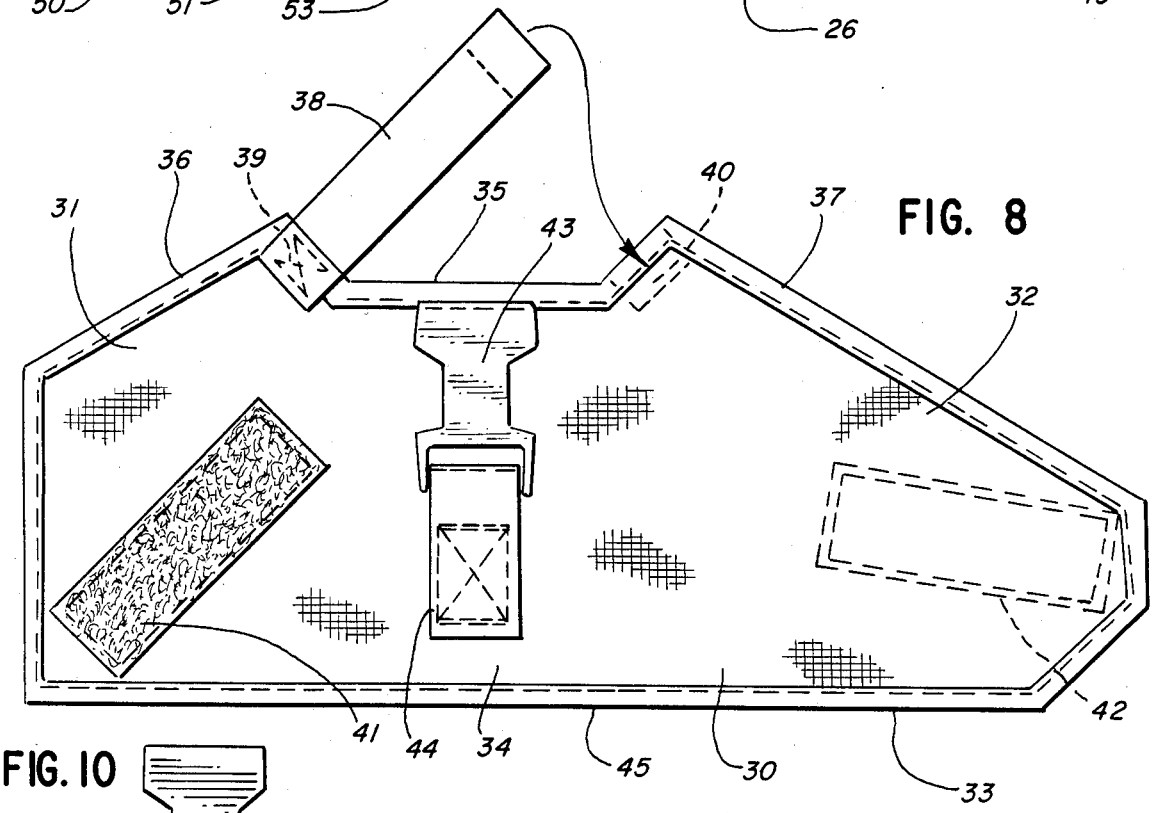
FIG. 8 is a plan view on one of the fabric mounting members.

Referring now to FIG. 8, the upper mounting member 24 includes a sheet of nylon fabric 30 which is somewhat triangularly shaped. The fabric includes a pair of end portions 31 and 32 which have a common straight edge 33 and a central portion or bight portion 34 which bisects the end portions 31 and 32. The bight portion 34 has a straight edge 35 which extends between the angled edges 36 and 37 of the end portions. A nylon web strap 38 is attached at 39 to the end portion 31. The fabric sheet is thereafter formed into a channel shape or U-shape by folding along the bight portion 34, and the strap 38 is stitched at 40 to the end portion 32 to maintain the fabric sheet in a U-shape. A Velcro loop strap 41 is attached to the end portion 31 on the facing surface in FIG. 8, and a Velcro hook strap 42 is attached to the end portion 32 on the other surface of the fabric sheet. The Velcro straps are arranged so that they will be generally parallel and overlapping when the end portions 31 and 32 are wrapped around the bow riser 17. A female buckle 43 is attached to the bight portion 34 by a nylon mesh strap 44. A nylon tape 45 overlaps the edges of the nylon sheet and is attached by stitching to keep the edges of the sheet from fraying.

The mounting member 25 is similarly formed except that it includes a male buckle 46 (FIG. 4) rather than a female buckle. The buckles are advantageously conventional quick release slide buckles of the type which are commonly used on life vests and back packs.

Figure 7:
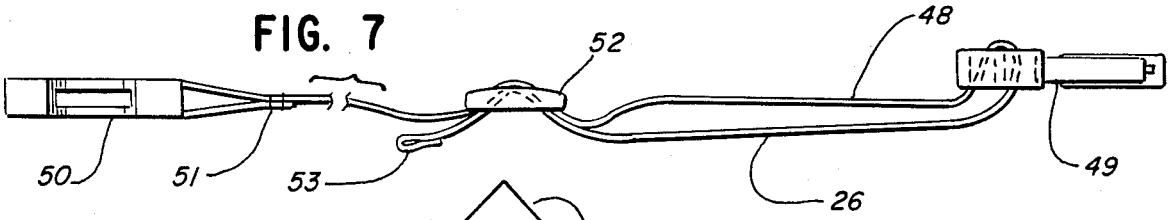
FIG. 7 is a side elevational view, partially broken away, of the sling.

Referring to FIGS. 6 and 7, the sling 26 includes a nylon mesh strap 48 and male and female slide buckles 49 and 50. One end of the strap is looped around the end of the female buckle 50 and secured by stitching 51. The other end of the strap is looped through the end of the male buckle 49 and looped through a slide adjuster 52. The free end 53 of the strap can be secured by wrapping a Velcro strap around the free end and the strap 48.

Each of the U-shaped mounting members 24 and 25 is mounted on the bow by positioning the elbow 27 between the limb and the riser in the pocket of the mounting member which is formed by the channel of the bight portion 34 and the strap 38 which connects the end portions 31 and 32. The end portion 31 which contains the Velcro loop patch 41 is then wrapped in around the back portion of the bow riser 17. Then, while holding portion 31 in position with one hand, end portion 32 is wrapped around the opposite side of riser 17, pulled taut, and the hook Velcro patch 42 is brought into contact with the loop Velcro patch. The mounting member is retained in position on the end of the riser by the connecting strap 38 and the secured ends 31 and 32.

The sling strap 48 is attached by connecting its male and female buckles 49 and 50 to the male and female buckles 46 and 43 of the lower and upper mounting members, respectively. The length of the sling strap can be adjusted as desired by the slide adjuster 52.

The flexible fabric and the Velcro securing means of the mounting members enable the mounting members to be mounted on bows of different shapes and sizes. The slide buckles permit the sling to be quickly and easily attached and detached with one hand. By using male and female buckles on the sling, the sling can be used as a belt of fastening strap when the sling is not attached to the bow. It will be understood, however, that the same kind of buckles can be used on each of the mounting members, and mating buckles can be used on the sling.

Figure 10:
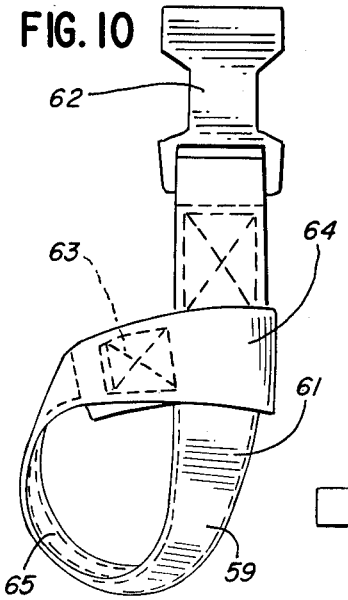
FIG. 10 illustrates the barrel mounting member of the gun sling assembly.
Figure 9:
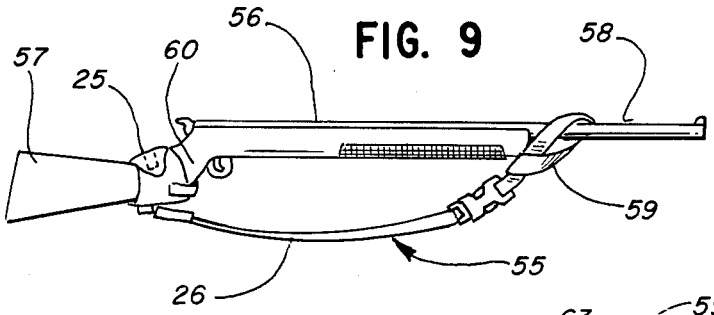
FIG. 9 is an elevational view of a sling assembly for a gun.
Figure 11:
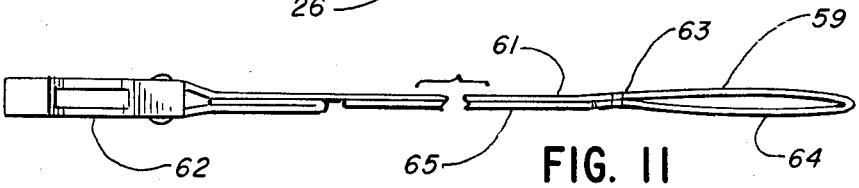
FIG. 11 is a side elevational view, partially broken away, of the barrel mounting member.

FIGS. 9–11 illustrate a sling assembly 55 for a gun 56 having a stock 57 and a barrel 58. The sling assembly 55 includes the lower mounting member 25 and the sling 26 of the bow sling assembly 15 and a gun mounting member 59. The mounting member 25 is mounted on the hand grip portion 60 of the stock 57 in a manner similar to the procedure for attaching the mounting member to a bow. The elbow of the grip 60 is inserted into the pocket of the U-shaped fabric mounting member, and the end portions of the mounting member are wrapped around the stock and secured by the Velcro straps.

The gun mounting member 57 includes a nylon mesh strap 61 and a female slide buckle 62. One end of the strap is connected to the buckle 62, and the other end of the strap is reversely folded and stitched at 63 to form a loop 64. A vinyl strip 65 is sewn to one side of the strap 61 to provide a gripping surface so that the strap will not slide on the gun barrel 58.

The gun mounting member is attached to the barrel by inserting the buckle 62 through the loop 64 to form a noose as illustrated in FIG. 10. The barrel is inserted into the noose, and the noose is tightened around the barrel. The sling is then attached to the buckle 62.

While in the foregoing specification a detailed description of specific embodiments of the invention were set forth for the purpose of illustration, it will be understood that many of the details herein given may be varied considerably by those skilled in the art without departing from the spirit and scope of the invention.

I claim:

1. A mounting member for mounting a sling on a bow, a gun or the like comprising a sheet of flexible material which is adapted to be wrapped around a bow or a gun stock, said sheet being folded into a generally U-shaped configuration having a bight portion and a pair of end portions, a strap extending between the end portions and secured to the end portions to maintain the U-shaped configuration of the sheet whereby the bight portion and the strap form a pocket which can be positioned against a junction between a riser and a limb of a bow or on a grip portion of a rifle stock, the end portions being adapted to be wrapped around a bow or rifle stock, securing means on the end portions of the sheet for releasably securing the end portions in the wrapped configuration, and attaching means of a sheet for attaching a sling to the sheet.

2. The mounting member of claim 1 in which the securing means comprises hook and loop fasteners on the sheet.

3. The mounting member of claim 1 in which the attaching means comprises a buckle.

4. The mounting member of claim 1 in which the attaching means is located on said bight portion.

5. A sling assembly for a bow comprising a pair of mounting members for mounting on a bow, a sling, and attaching means on the mounting members and the sling for releasably attaching the sling to the mounting members, each of the mounting members comprising a sheet of flexible material which is adapted to be wrapped around a bow, each of said sheets being folded into a generally U-shaped configuration having a bight portion and a pair of end portions, a strap extending between the end portions and attached to the end portions for maintaining the U-shaped configuration of the sheet whereby the bight portion and the strap form a pocket which can be positioned against a junction between a riser and a limb of a bow, and securing means on the end portions of the sheet for releasably securing the end portions in the wrapped configuration.

6. The sling assembly of claim 5 in which the securing means comprises hook and loop fasteners on each of said sheets.

7. The sling assembly of claim 5 in which the attaching means comprises a buckle on each of the mounting members and mating buckles on the sling.

8. The sling assembly of claim 5 in which the attaching means of each of the mounting members is attached to the bight portion thereof.

9. A sling assembly for a gun comprising a first mounting member for mounting on a stock of a gun, a second mounting member for mounting on a barrel of a gun, a sling, and attaching means on the sling and on the first and second mounting members for releasably attaching the sling to the mounting members, the first mounting member comprising a sheet of flexible material which is adapted to be wrapped around a gun stock, said sheet being folded into a generally U-shaped configuration having a bight portion and a pair of end portions, a strap extending between the end portions of the sheet and secured to the end portions, and securing means on the end portions of the sheet for releasably securing the end portions in the wrapped configuration whereby the bight portion and the strap form a pocket which can be positioned against a grip portion of a gun stock, the second mounting member comprising a flexible strap having a pair of ends one of the ends of the strap having a loop whereby the other end of the strap can be inserted through the loop to form a noose which can tighten around a barrel of a rifle, the attaching means for the second mounting member being mounted on said other end of the strap.

10. The sling assembly of claim 9 in which said attaching means comprises mating buckles on said sling and said first and second mounting members.

* * * * *